United States Patent [19]

Schneider

[11] Patent Number: 4,840,364

[45] Date of Patent: Jun. 20, 1989

[54] COMBINATION FOLDING AND CUT PRODUCT ATTACHMENT APPARATUS

[75] Inventor: Eckhard Schneider, Stadtbergen, Fed. Rep. of Germany

[73] Assignee: Man - Roland Druckmaschinen AG, Offenbach am Main, Fed. Rep. of Germany

[21] Appl. No.: 111,042

[22] Filed: Oct. 20, 1987

[30] Foreign Application Priority Data

Oct. 24, 1986 [DE] Fed. Rep. of Germany ..... 3636244

[51] Int. Cl.[4] ..... B41L 43/04

[52] U.S. Cl. ..... 270/38; 270/53; 270/37

[58] Field of Search ..... 270/37, 38, 47, 53, 270/58

[56] References Cited

U.S. PATENT DOCUMENTS

| | | | |
|---|---|---|---|
| 2,131,363 | 9/1938 | Barber | 270/47 |
| 2,137,978 | 11/1938 | Mills et al. | 270/37 |
| 2,364,504 | 12/1944 | Zuckerman | 270/53 |

FOREIGN PATENT DOCUMENTS

| | | | |
|---|---|---|---|
| 1157632 | 11/1963 | Fed. Rep. of Germany | 270/38 |
| 3030706 | 2/1982 | Fed. Rep. of Germany . | |
| 42 | of 1911 | United Kingdom . | |

OTHER PUBLICATIONS

Octoman, M.A.N. brochure #235828/1 D, printed Mar. 1986.

Koebau-Compact A 35/Koenig & Bauer brochure #018/81-D, printed Oct. 1982.

Alexander Brown-Atlas of Newspaper-and Illustration-Printing Polygraph Verlag GmbH, Frankfurt, 5/1954.

*Primary Examiner*—Robert E. Garrett

*Assistant Examiner*—Therese M. Newholm

*Attorney, Agent, or Firm*—Frishauf, Holtz, Goodman & Woodward

[57] ABSTRACT

To permit selectively stapling paper products which are to be folded in advance of formation of a first or a second cross fold, a stapling cylinder (18) can be selectively placed in engagement with a first folding blade cylinder (5) carrying transport needles (6) or a second folding blade cylinder (10) having folding blades and grippers (11) thereon. If the stapling cylinder (18) is engaged with the first needle and folding blade cylinder (5), staples can be placed into the products prior to formation of the first cross fold at the position of the fold line. Upon engagement of the stapling cylinder (18) on the gripper and folding blade cylinder (10), the once folded products are stapled at the fold line of a second fold, which is then carried out after stapling. The respective first and second folding blade cylinders include staple counter plates (13) to close the staples supplied by the staple applying stapling cylinder (18).

6 Claims, 1 Drawing Sheet

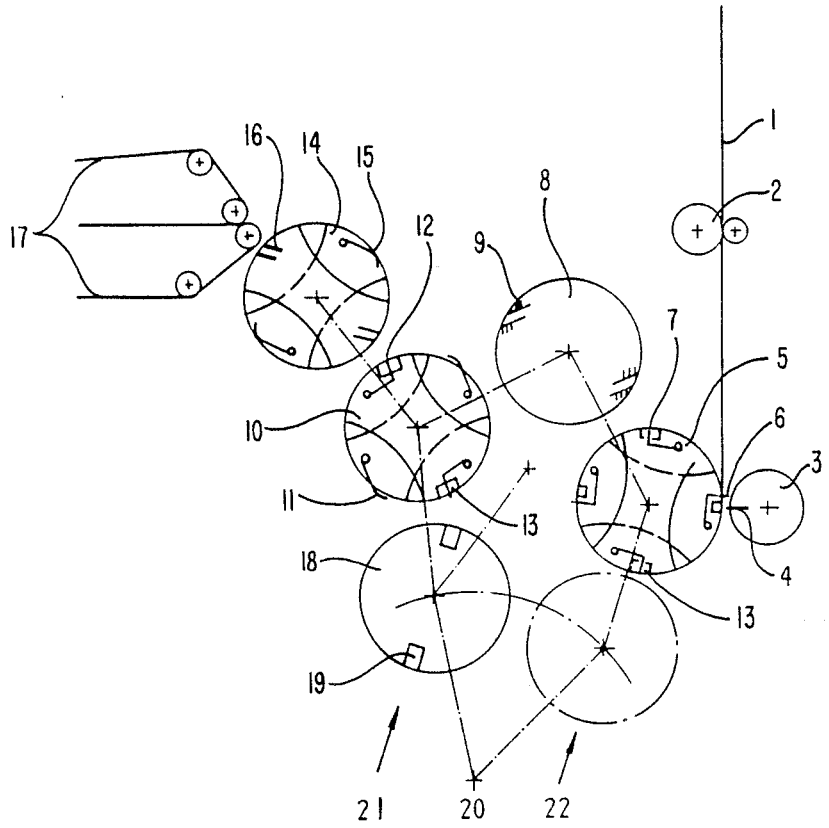
1
2
3
4
5
6
7
8
9
10
11
12
13
13
14
15
16
17
18
19
20
21
22

COMBINATION FOLDING AND CUT PRODUCT ATTACHMENT APPARATUS

Reference to related publication: German Patent Disclosure Document No. DE-OS 30 30 706. Reference to related application, assigned to the assignee of the present invention, the disclosure of which is hereby incorporated by reference: U.S. Ser. No. 111,012, filed Oct. 20, 1987, Schneider.

The present invention relates to paper handling apparatus, and more particularly to apparatus handling printed products which are folded and, upon folding, are stapled or otherconnected together. Folding can be in one or two folds, and the apparatus and system should be versatile to permit stapling either after a first fold or after two folds, with a minimum of change-over of the apparatus.

BACKGROUND

Folding apparatus which are combined with stapling apparatus are known in the sheet handling field. Sheets, as used herein, may be severed portions of a continuous web, for example from a web-fed printing machine, or other sheet products. The substrate for the products is typically paper, but may be other materials, and the printing machine may receive the substrates in web or sheet form.

German Patent Disclosure Document No. DE-OS 30 30 706 describes a folding apparatus in which a printed paper web is cut. The cut products are gripped on a folding blade cylinder which has holding needles thereon, the folding blade cylinder cooperating with a first folding flap cylinder to form a first transverse fold. The folding flap cylinder, besides having the folding flaps, additionally carries needles for needling the products and folding blades. A second transverse fold is formed by cooperation of the first folding flap - folding blade cylinder with a second folding flap cylinder.

The system permits connection of a plurality of printed products by a stapling cylinder associated with the combined needle and folding flat-blade cylinder to staple the folded products on the fold line which is to be generated at the first cross fold. It is not possible in this apparatus to provide for stapling along the fold line of the second fold. The first folding flap - folding blade and needle cylinder thus has the additional function of providing for stapling and the multitude of functions associated with such a single element renders the structure complex, difficult to make and to maintain in use.

THE INVENTION

It is an object to provide a combination folding - connecting apparatus, typically a stapling apparatus, in which a stapling cylinder can staple the folded products along a second, transverse cross fold at the position where the fold line is to be formed, without any expensive and complex construction of cylinders and paper handling elements; and preferably also to permit selective stapling of the products along the fold line of the first transverse fold or of the second transverse or cross fold, without extensive rearrangement of the machine or the paper handling system.

Briefly, a first folding blade cylinder, equipped with pick-up needles, receives cut products, that is, either sheets or a cut web. The first folding blade cylinder cooperates with a first folding flap cylinder, the pair of first cylinders forming a first cross fold. The first folding flap cylinder has no other function than to form the first cross fold, and thus only carries the folding flaps. A second folding blade cylinder, cooperating with a second folding flap cylinder, receives the products which have the first cross fold formed therein, to permit placement of a second cross fold. The second folding blade cylinder additionally has grippers placed thereon to receive and grip products from the first folding flap cylinder and, upon operation of the folding blades thereon, form the second cross fold by pushing the products into the folding flaps of the second folding flap cylinder. A stapling cylinder is provided which has a stapling mechanism, which stapling cylinder is selectively engageable with either the second folding blade cylinder or the first folding blade cylinder. The respective folding blade cylinders then only have to carry a stapling closing element to close the staples being placed thereon by the stapling cylinder. The staples are applied at the line which, later on, is pushed by the folding blades into the folding flap cylinder.

The system has the advantage of being highly flexible, permitting stapling at the first cross fold or at the second cross fold, selectively; to form a first cross fold only, by transfer of sheets via the grippers of the second folding blade cylinder while disabling the folding blades thereof, or of making two folds.

The stapling apparatus, typically a stapling cylinder, can be used in form of a standard rotary stapling apparatus, without in any way rebuilding or changing standard paper handling cylinder mechanisms, such as folding blade and folding flap cylinders. Application of a counter element to close the staples is a simple matter and does not require rebuilding or redesign of otherwise standard folding blade cylinders.

DRAWING

The single FIGURE is a schematic representation of the combination folding and attachment system in accordance with the present invention, in which the respective cylinders are shown only in schematic outline since they can all be of standard and well known construction.

DETAILED DESCRIPTION

One or more superposed webs 1, which may have printed subject matter placed thereon on one or both sides, are pulled by a pair of pulling rollers 2 to the system of cylinders of the present invention. A cutter blade cylinder 3 with a cutter knife 4 cuts the web 1 into sheets of suitable and desired length. The sheets are retained on a first folding blade cylinder 5. The folding blade cylinder is equipped with needles 6, which retain the sheets thereon.

A first cross fold is formed by cooperation of the first folding blade cylinder 5 with a first folding flap cylinder 8. Folding blades 7 on the folding blade cylinder 5 are pushed into folding flaps 9 of the folding flap cylinder 8. In accordance with a feature of the invention, the folding flap cylinder 8 is of the simplest possible construction, since it is only required that the folding flap cylinder 8 has folding flaps 9. This results in an inexpensive and simple arrangement and an inexpensive and simple construction for the folding flap cylinder 8.

The folding flap cylinder 8, thus, retains the products thereon, with one cross fold formed therein. These products are transferred to a second folding blade cylinder 10. Folding blade cylinder 10 has grippers 11 thereon, which grip the sheets on folding flap cylinder 8 for transfer to the cylinder 10. Besides the grippers 11, the folding blade cylinder 10 has folding blades 12, to permit forming a second cross fold by engagement of the folding blades 12 through the products into the folding flaps 16 of a second folding flap cylinder 14. Preferably, the folding flap cylinder 14 also has grippers 15. The twice folded products, then, are delivered, for example to a delivery transport system 17 of any suitable construction, for example, and as shown in the FIGURE, a belt system.

In accordance with a feature of the invention, the second folding blade cylinder 10 has staple closers 13 located thereon. Such staple closers need not be any special products, but can be shaped as is well known and standard in the paper handling field, when webs of paper are to be joined together. To introduce the staples into the products, and in accordance with a feature of the invention, a stapling cylinder 18 is provided, for engagement and cooperation with the second folding blade cylinder 10. The stapling cylinder 18 has a stapling gun or stapling blade arrangement 19 located thereon; as shown, two such elements are provided to cooperate, on each half revolution, with the cylinder 10. The stapling gun or stapling apparatus 19 thus can push staples through the already once transversely folded products at the fold line where, subsequently and upon projection of the folding blades 12, the second cross fold is to be formed.

The arrangement, as can be seen, is simple in comparison to known structures, since the structure of a gripper and folding blade cylinder 10 is well known and simple if only two circumferentially placed elements are to be controlled. The stapling counter element 13 need not move.

The system is versatile and, in accordance with a feature of the invention, the stapling cylinder 18 can be so located in a frame (not shown) of the machine that the shaft or axis position thereof can be changed, for selective engagement with either the first folding blade cylinder 5 or the second folding blade cylinder 10. As shown in the FIGURE, the center of the stapling cylinder 18 can be switched in an arc about a central switching point 20 from position 21, in engagement with the gripper and folding blade cylinder 10 to a position 22, in engagement with the needle and folding blade cylinder 5.

If the stapling cylinder 18 is engaged with the first folding blade cylinder 5, the first folding blade cylinder 5 also must be euqipped with closing plates or closing elements 13, which can be identical to those on the second folding blade cylinder 13. This arrangement, then, selectively permits use of a single stapling cylinder which can be selectively used to either staple the products before the first transverse or cross fold is made, or after the first transverse or cross fold has been made, and in advance of the second cross fold, upon merely changing the position of the cylinder 18 from position 22 to position 21.

By placing the stapling cylinder 18 in position 22, that is, in engagement with the needle and folding blade cylinder 5, the first cross fold only is stapled. The folding blades 12 of the gripper and folding blade cylinder 10 and the folding flaps 16 of the gripper and folding flap cylinder 14 then are placed out of operation and cylinders 10 and 14 merely act as product transfer or product transport elements. In such an operation, the once transversely folded product is transferred, as described above, to the grippers 11 on the second folding blade cylinder 10 from the folding flaps 9 of the first folding flap cylinder; and then transferred therefrom to the grippers 15 on the second folding flap cylinder 16. The once transversely folded products can then be delivered to the delivery transport system 17, as well known and standard in its field.

The various cylinders can all be of standard construction, and control of the respective grippers, folding blades, stapling gun or apparatus or the like, can be effected, as is well known, by cams or the like which, in turn, are suitably positioned to provide for timed operation of the respective blades or grippers as the cylinders rotate for synchronized operation on the products thereon.

Various changes and modifications may be made within the scope of the inventive concept.

I claim:

1. Combination folding and cut product or sheet attachment apparatus, particularly for association with a material handling system, for example from a printing machine, delivering printed products in cut sheet form, comprising a first folding blade cylinder (5) having pick-up needles (6) located on the cylinder;

a first folding flap cylinder (8) having folding flaps (9) cooperating with said first folding blade cylinder for receiving the products and forming a first cross fold therein;

a second folding blade cylinder (10) having folding blades (12);

a second folding flap cylinder (14) having folding flaps (16) cooperating with said second folding blade cylinder (10) for receiving the products and forming a second cross fold therein, and wherein said first folding flap cylinder (8) essentially includes only said folding flaps (9);

and said second folding blade cylinder (10) is formed with grippers (11) for receiving and gripping said products from said first folding flap cylinder (8) and, upon folding operation of the folding blades (12) on the second folding blade cylinder, forming a second cross fold by pushing the products into the folding flaps (16) of the second folding flap cylinder (14), and wherein, further, a stapling cylinder (18) is provided, having a stapling mechanism thereon, and each of said blade cylinders (5, 10) has a staple closing means (13) located thereon, said stapling cylinder (18) being selectively engageable with a selected one of said folding blade cylinders (5, 10) and, upon engagement therewith, for stapling the products, said staple closing means (13) on the selected folding blade cylinder closing the staples applied thereto.

2. The combination of claim 1, wherein said stapling cylinder (18) and said second folding blade cylinder (10) are relatively circumferentially positioned for placement of the products in a position such that, upon folding, the staples will be applied at the second cross fold which will be formed by the second folding blade cylinder (10) and the second folding flap cylinder (14).

3. The combination of claim 2, wherein said stapling cylinder (18) applies staples prior to operation of the folding blades (12) of the second folding blade cylinder (10) to form, in cooperation with the second folding flap cylinder, the second cross fold in the stapled product.

4. The combination of claim 1, wherein said stapling cylinder (18), upon engagement with said first folding blade cylinder (5), places the staples in a position on the product which, upon operation of folding blades (7), forms the first cross fold in cooperation with said first folding flap cylinder (8).

5. The combination of claim 1, wherein the products are formed with only said first cross fold, wherein said second folding blade cylinder and said second folding flap cylinder operate as transport or transfer cylinders, the folding blades (12) of the second folding blade cylinder and the folding flaps (16) of the second folding flap cylinder being disabled, and the products, once folded with the first transverse fold, are transferred by the grippers (11) on the second folding blade cylinder; and grippers (15) are secured to said second folding flap cylinder, to transfer sheets from said second folding blade cylinder.

6. The combination of claim 5, further including a belt delivery and transport system (17) receiving products from said second folding blade cylinder (14).

* * * * *